US008565630B2

(12) United States Patent
Kim et al.

(10) Patent No.: US 8,565,630 B2
(45) Date of Patent: Oct. 22, 2013

(54) IMAGE FORMING APPARATUS CAPABLE OF COMPENSATING FOR A TEMPERATURE OF A FIXING UNIT AND CONTROL METHOD THEREOF

(75) Inventors: Young-Chul Kim, Seoul (KR); Jung-woo Son, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 330 days.

(21) Appl. No.: 12/923,667

(22) Filed: Oct. 1, 2010

(65) Prior Publication Data

US 2011/0142470 A1 Jun. 16, 2011

(30) Foreign Application Priority Data

Dec. 16, 2009 (KR) ..... 10-2009-0125308

(51) Int. Cl.
*G03G 15/20* (2006.01)

(52) U.S. Cl.
USPC ..... 399/69

(58) Field of Classification Search
USPC ..... 399/69, 70
See application file for complete search history.

(56) References Cited

U.S. PATENT DOCUMENTS 7,109,440 B2 * 9/2006 Lee ..... 219/216

FOREIGN PATENT DOCUMENTS

JP 08227249 A * 9/1996
JP 11327358 A * 11/1999

OTHER PUBLICATIONS

Computer translation of JP08-227249A to Kagawa, Sep. 1996.*

* cited by examiner

*Primary Examiner* — Quana M Grainger
(74) *Attorney, Agent, or Firm* — Staas & Halsey LLP

(57) ABSTRACT

A method of controlling an image forming apparatus and method thereof including a medium feeder configured to load therein and to pick up and feed a printing-target medium; an image forming unit configured to form an image on the printing-target medium that is picked up and fed; and a fixing unit configured to fix the printed medium on which the image has been formed, the method including: heating the fixing unit such that a temperature of the fixing unit reaches a fixing reference temperature determined corresponding to the printing-target medium if an printing operation is started; sensing the temperature of the fixing unit corresponding to the start of the printing operation and compensating a pickup timing temperature corresponding to whether the sensed temperature thereof is higher or lower than a predetermined first reference temperature, the pickup timing temperature being a temperature for picking up the printing-target medium; and picking up the printing-target medium when the temperature of the fixing unit that is being heated reaches the compensated pickup timing temperature.

16 Claims, 9 Drawing Sheets

IMAGE FORMING APPARATUS CAPABLE OF COMPENSATING FOR A TEMPERATURE OF A FIXING UNIT AND CONTROL METHOD THEREOF

CROSS-REFERENCE TO RELATED APPLICATIONS

This application claims priority from Korean Patent Application No. 10-2009-0125308, filed on Dec. 16, 2009 in the Korean Intellectual Property Office, the disclosure of which is incorporated herein by reference.

BACKGROUND

1. Field

Apparatuses and methods consistent with the exemplary embodiments relate to an image forming apparatus which fixes a printed medium by a fixing unit and a method of controlling the same, and more particularly, to an image forming apparatus having a structure which improves a fixing of a printed medium and a method of controlling the same.

2. Description of the Related Art

An image forming apparatus forms a visual image by a developing solution on a printing-target medium and fixes such an unfixed visual image on a printed medium by applying a heat and a pressure thereto by a fixing unit. The fixing unit includes a heat emitting unit which generates a heat; and a pressure roller which is pressured with regard to the heat emitting unit to form a nip. Such fixing is carried out by allowing a printed medium to pass through the nip to which the heat and the pressure are applied.

The image forming apparatus heats the fixing unit such that the temperature of the fixing unit reaches a fixing reference temperature upon receiving a printing start command in a stand-by state. The image forming apparatus actuates a pickup roller to pick up and feed a printing target medium if the temperature of the fixing unit reaches a pickup timing temperature that is set to be lower than the fixing reference temperature by a predetermined temperature value.

Here, the temperature of the fixing unit may vary at a point of time when the fixing unit starts to be heated. For example, the temperature of the fixing unit in the case that a long time has elapsed since the stand-by state may significantly be lower than the temperature thereof in the case that a short time has elapsed since the stand-by state.

In the meantime, while the printed medium passes through the fixing unit, the printed medium absorbs the heat of the fixing unit. Accordingly, if the printing operation is started after a long time has elapsed since the stand-by state, the temperature of the fixing unit may significantly be reduced as the fixing of the printed medium is in progress. For that reason, the fixing may abnormally be performed at the back side of the printed medium that has passed through the fixing unit, thereby generating a fixing error.

SUMMARY

Accordingly, one or more exemplary embodiments provide an image forming apparatus and a method of controlling the same, capable of preventing a fixing error at the back side of a printed medium.

The foregoing and/or other aspects may be achieved by providing a method of controlling an image forming apparatus including a medium feeder configured to load therein and to pick up and feed a printing-target medium; an image forming unit configured to form an image on the printing-target medium that is picked up and fed; and a fixing unit configured to fix the printed medium on which the image has been formed, the method including: heating the fixing unit such that a temperature of the fixing unit reaches a fixing reference temperature determined corresponding to the printing-target medium if an printing operation is started; sensing the temperature of the fixing unit corresponding to the start of the printing operation and compensating a pickup timing temperature corresponding to whether the sensed temperature thereof is higher or lower than a predetermined first reference temperature, the pickup timing temperature being a temperature for picking up the printing-target medium; and picking up the printing-target medium when the temperature of the fixing unit that is being heated reaches the compensated pickup timing temperature.

The compensating of a pickup timing temperature may include performing offset compensation of a default value of the pickup timing temperature as a relatively lower temperature if the sensed temperature of the fixing unit is lower than the first reference temperature.

The picking-up of the printing-target medium may include fixing the printed medium on which the image has been formed after being picked up, and the performing compensation of a default value of the pickup timing temperature as a relatively lower temperature includes performing of compensation of the pickup timing temperature such that the temperature of the fixing unit when the printed medium is separated from the fixing unit is equal to or higher than the fixing reference temperature.

The picking-up of the printing-target medium may include fixing the printed medium on which the image has been formed after being picked up, and the fixing of the printed medium may include performing no heating of the fixing unit during at least a partial area of a time section where the temperature of the fixing unit higher than the fixing reference temperature such that the temperature of the fixing unit approaches to the fixing reference temperature while the printed medium is fixed; and heating the fixing unit during at least a part of the partial area if the sensed temperature of the fixing unit is lower than the first reference temperature and the fixing reference temperature is lower than a second reference temperature.

The compensating of a pickup timing temperature may include performing compensation of a default value of the pickup timing temperature as a relatively higher temperature if the sensed temperature of the fixing unit is higher than the first reference temperature.

The performing of compensation of a value of the pickup timing temperature as a relatively higher temperature may include performing compensation of the pickup timing temperature such that a time period between a point of time when the temperature of the fixing unit is higher than the fixing reference temperature and a point of time when the printed medium goes to the fixing unit is relatively elongated.

A predetermined first temperature range may include the first reference temperature, and the compensating of a pickup timing temperature may include performing no compensation of a value of the pickup timing temperature if the sensed temperature of the fixing unit is positioned in the first temperature range.

Another aspect of the present invention may be achieved by providing an image forming apparatus including: a medium feeder configured to load therein and to pick up and feed a printing-target medium; an image forming unit configured to form an image on the printing-target medium that is picked up and fed; a fixing unit configured to fix by a heat the printed medium on which the image has been formed; and a controller configured to heat the fixing unit such that a temperature of the fixing unit reaches a predetermined fixing reference temperature corresponding to the printing-target medium if an printing operation is started, to sense the temperature of the fixing unit corresponding to the start of the printing operation, to compensate a pickup timing temperature corresponding to whether the sensed temperature thereof is higher or lower than the predetermined first reference temperature, the pickup timing temperature being a temperature for picking up the printing-target medium, and to control the medium feeder to pick up the printing-target medium when the temperature of the fixing unit that is being heated reaches the compensated pickup timing temperature.

The controller may perform compensation of a value of the pickup timing temperature as a relatively lower temperature if the sensed temperature of the fixing unit is lower than the first reference temperature.

The controller may perform compensation of the pickup timing temperature such that the temperature of the fixing unit when the printed medium is separated from the fixing unit is equal to or higher than the predetermined fixing reference temperature.

The controller may perform no heating of the fixing unit during at least a partial area of a time section where the temperature of the fixing unit higher than the fixing reference temperature such that the temperature of the fixing unit approaches to the fixing reference temperature while the printed medium is fixed; and The controller may heat the fixing unit during at least a part of the partial area if the sensed temperature of the fixing unit is lower than the first reference temperature and the fixing reference temperature is lower than a second reference temperature.

The controller may perform compensation of a value of the pickup timing temperature as a relatively higher temperature if the temperature of the fixing unit is higher than the first reference temperature.

The controller may perform compensation of the pickup timing temperature such that a time period between a point of time when the temperature of the fixing unit is higher than the fixing reference temperature and a point of time when the printed medium goes to the fixing unit is relatively elongated.

A predetermined first temperature range may include the first reference temperature, and the controller may perform no compensation of a default value of the pickup timing temperature if the sensed temperature of the fixing unit is in the first temperature range.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Figure 1:
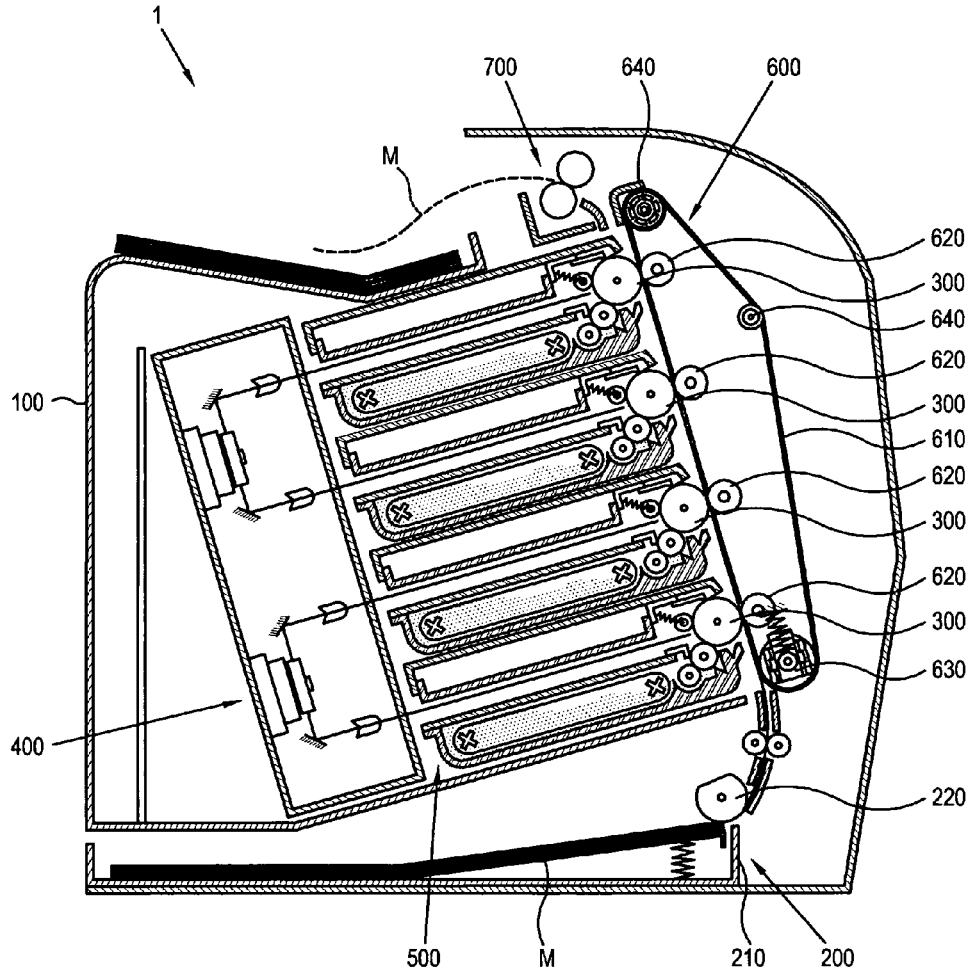
FIG. 1 is a side view showing an image forming apparatus in accordance with an exemplary embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout. Throughout the description of the exemplary embodiments, only elements directly relative to the sprit and scope of the exemplary embodiments are described, while the description of other elements may be omitted. This, however, does not mean that the omitted elements are not essential to embody an image forming apparatus 1 of the exemplary embodiments.

FIG. 1 is a side view showing the image forming apparatus 1 in accordance with an exemplary embodiment. The structure of the image forming apparatus 1 shown in FIG. 1 is merely an example selected to describe the exemplary embodiments. The spirit and scope thereof is applicable to various types of the image forming apparatus 1 which forms an image on a printing-target medium by a developing solution.

As shown in FIG. 1, the image forming apparatus 1 of the present embodiment may include a main body housing 100 which constitutes an outer appearance thereof; a medium feeder 200 which loads therein printing-target medium M to pick up and feed the load printing-target medium M; an image forming unit 300, 400, 500, and 600 which forms an image on the printing-target medium M fed from the medium feeder 200; and a fixing unit 700 which fixes the images on the printed media M by using a heat and a pressure. It is noted that a printing-target medium M refers to a medium on which the image is not formed yet.

The image forming unit 300, 400, 500, and 600 may include an image receptor 300 which forms a latent electrostatic image and a visual image on a surface; an exposure unit 400 which exposes the image receptor 300 to form the latent electrostatic image; a developing cartridge 500 which applies a developing solution to the latent electrostatic image of the image receptor 300 to form the visual image; and a transfer unit 600 which transfers the visual image of the image receptor 300 on the printing-target medium M.

Hereinafter, each component of the image forming apparatus 1 will be described.

The medium feeder 200 may include a loading cassette 210 which is attachable to the main body housing 100; and a pickup roller 220 which picks up printing-target media M loaded in the loading cassette 210. The loading cassette 210 may be separated from the main body housing 100 to load the printing-target media M therein. After the printing-target media M are loaded therein, the loading cassette 210 may be mounted in the main body housing 100. If a printing operation is started, the pickup roller 220 may pick up a top printing-target medium M of the printing-target media M loaded in the loading cassette 210 to feed the picked-up top printing-target media M to the image receptor 300 and the transfer unit 600.

The image receptor 300 may be arranged successively arranged in a plural number per color along a moving path through which the printing-target media M are moved. The image receptors 300 may correspond to four colors, i.e., yellow, magenta, cyan, and block, respectively.

The image receptors 300 may form on a surface a latent electrostatic image based on image data of each color. If a developing solution is applied to the latent electrostatic image, the developing solution may selectively be attached according to the electric potential difference, thereby allowing the image receptor 300 to form a visual image by the developing solution.

The exposure unit 400 may form the latent electrostatic image by scanning a light beam on each uniformly charged surface of the exposure units 300 based on the image data of each color. The exposure unit 400 may be embodied as a light scanning unit including a light source (not shown), a polygon lens (not shown), and various optical lenses (not shown).

The developing cartridge 500 may also be installed in a plural number to correspond to the image receptors 300 of each color. The developing cartridges 500 may respectively contain developing solutions of each color therein to apply the contained developing solutions to each of the image receptors 300. For example, the developing cartridges 500 may respectively contain developing solutions of the four colors, i.e., yellow, magenta, cyan, and block and form visual images of colors on each of the image receptors 300 by applying the developing solutions to latent electrostatic images thereof.

The transfer unit 600 may include a moving belt 610 which is moved along with the printing-target media M such that the printing-target media M are brought into contact with each image receptor 300; transfer rollers 620 arranged to correspond to the respective image receptors 300 with the moving belt 610 therebetween; an actuating roller 630 which actuates the moving belt 610 in a caterpillar method; and a support roller 640 which supports the moving belt 610 to supply a tension.

In a state where the printing-target medium M is arranged at outer side surfaces of the moving belt 610, the outer side surfaces on which the moving belt 610 is brought into contact with the image receptors 300, the moving belt 610 may be moved by the actuating roller 630 to allow the printing-target medium M to successively pass through each of the image receptors 300. While the printing-target medium M is moved by the moving belt 610, each visual image per color of the image receptors 300 may successively be transferred on the printing-target medium M by each of the transfer roller 620. Accordingly, the respective images per color may be overlapped on the printing-target medium M to form a final color image thereon.

The fixing unit 700 may fix the final color image by applying a heat and a pressure to the printed medium M on which the final color image has been transferred. The printed medium M that has completely subjected to such fixing by the fixing unit 700 may be outputted to an outside of the image forming apparatus 1.

Figure 2:
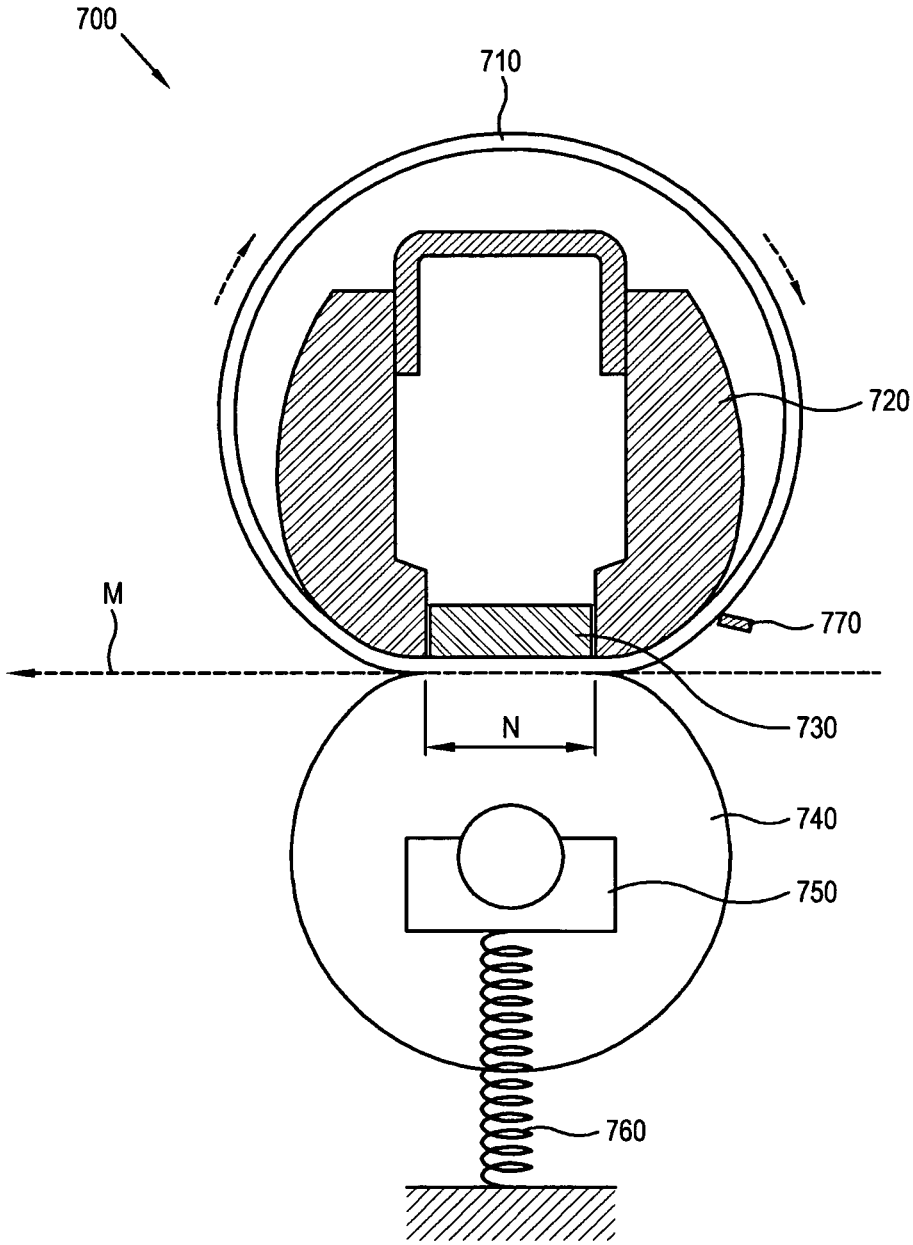
FIG. 2 is a side view showing a fixing unit which is applied to the image forming apparatus shown in FIG. 1.

Hereinafter, the detail configuration of the fixing unit 700 will be described with reference to FIG. 2. FIG. 2 is a side view showing the fixing unit 700.

As shown in FIG. 2, the fixing unit 700 may include a fixing belt 710 in which the developing solutions are passively rotated along the moving of the printing-target medium M; a guide frame 720 which rotatably supports the fixing belt 710; a heating plate 730 which is supported on an inner peripheral surface of the fixing belt 710 and generates a heat; a pressure roller 740 which pressure the printing-target medium M with regard to the fixing belt 710; and a sensing unit 770 which senses the temperature of the fixing unit 700.

The fixing belt 710 may have an outer peripheral surface which is brought into contact with the printing-target medium M and the inner peripheral surface in which the guide frame 720 and the heating plate 730 are installed. The fixing belt 710 may have a shape in which a left and a right end portion of a flexible film are connected to each other, the flexible film extending in a width direction of the printing-target medium M, and be rotatable in the forwarding direction of the printing-target medium M. The fixing belt 710 may passively be rotated by the moving printing-target medium M and supported by the guide frame 720, thereby forming a nip N between the fixing belt 710 and the pressure roller 740 without the deviation from its position. In the meantime, the fixing belt 710 may be required to be rotated in a state where the fixing belt 710 has been heated by the heat emitted from the heating plate 730. Accordingly, the fixing belt 710 may be made of a material having high resistance against the heat, the abrasion caused by the friction, and the deterioration.

The guide frame 720 may extend in a width direction of the printing-target medium M and support the inner peripheral surface of the fixing belt 710 such that the fixing belt 710 is rotated. Since the inner peripheral surface of the passively rotated the fixing belt 710 is sliding-rotated with regard to the guide frame 720, an outer shape of the guide frame 720 that is brought into contact with the fixing belt 710 may be formed in a round form, thereby allowing the fixing belt 710 to easily rotated.

The heating plate 730 may generate and emit a heat for the fixing and be supported on the inner peripheral surface of the fixing belt 710, the inner peripheral surface thereof which is brought into contact with the pressure roller 740. The heating plate 730 may extend in a width direction of the printing-target medium M and have a lower plate surface that is brought into contact with the inner peripheral surface pressurized by the pressure roller 740. Accordingly, the heat emitted from the heating plate 730 may be moved to the nip N through the lower plate surface of the heating plate 730 and the fixing belt 710.

Various configurations for generating the heat may be applied to the heating plate 730. For example, an electric heat wire (not shown) may be provided in a grating shape inside the heating plate 730. By supplying a power to the electric heat wire, the heating plate 730 may generate the heat.

In the present embodiment, the heating plate 730 may be employed as a component of the fixing unit 700 for generating the heat. The sprit and scope of the exemplary embodiment is not limited thereto. For example, a lamp (not shown) may be provided separately from the fixing unit 710 as a component of the fixing unit 700 for generating the heat. As such, the sprit and scope of the exemplary embodiment may also be applied to the fixing unit 700 of various configurations for generating the heat.

The pressure roller 740 may pressure the printed medium M toward the fixing belt 710. The pressure roller 740 may include a pair of bushings 750 which rotatably support opposite end portions of the pressurizing roller 740; and a spring 760 which elastically pressurizes the pair of the bushings 750 toward the fixing belt 710.

The pressure roller 740 may be pressure on the lower plate surface of the heating plate 730 by a pressure force of the spring 760. At this time, the fixing belt 710 may be interposed between the pressure roller 740 and the heating plate 730. Accordingly, the nip N on which the heat emitted from the heating plate 730 and the pressure caused by the pressurizing roller 740 are applied together may be formed between the pressure roller 740 and the outer peripheral surface of the fixing belt 710 that is pressure toward the heating plate 730 by the pressurizing roller 740. The fixing may be performed on the printed medium M by allowing the printed medium M to pass through the nip N.

The sensing unit 770 may be embodied as a thermistor and sense the temperature of the fixing unit 700, more detail, the fixing belt 710, to send the sensed temperature to a controller 900 which will be described later. The sensing position of the sensing unit 770 is not limited; however, the sensing unit 770 may be installed close to the nip N in a direction in which the printed medium M goes to the nip N. If the sensing unit 770 is installed in a direction in which the printed medium M is separated from the nip N, the accuracy of sensing the temperature may be lowered because the heat for the fixing is consumed by the printed medium M.

Figure 3:
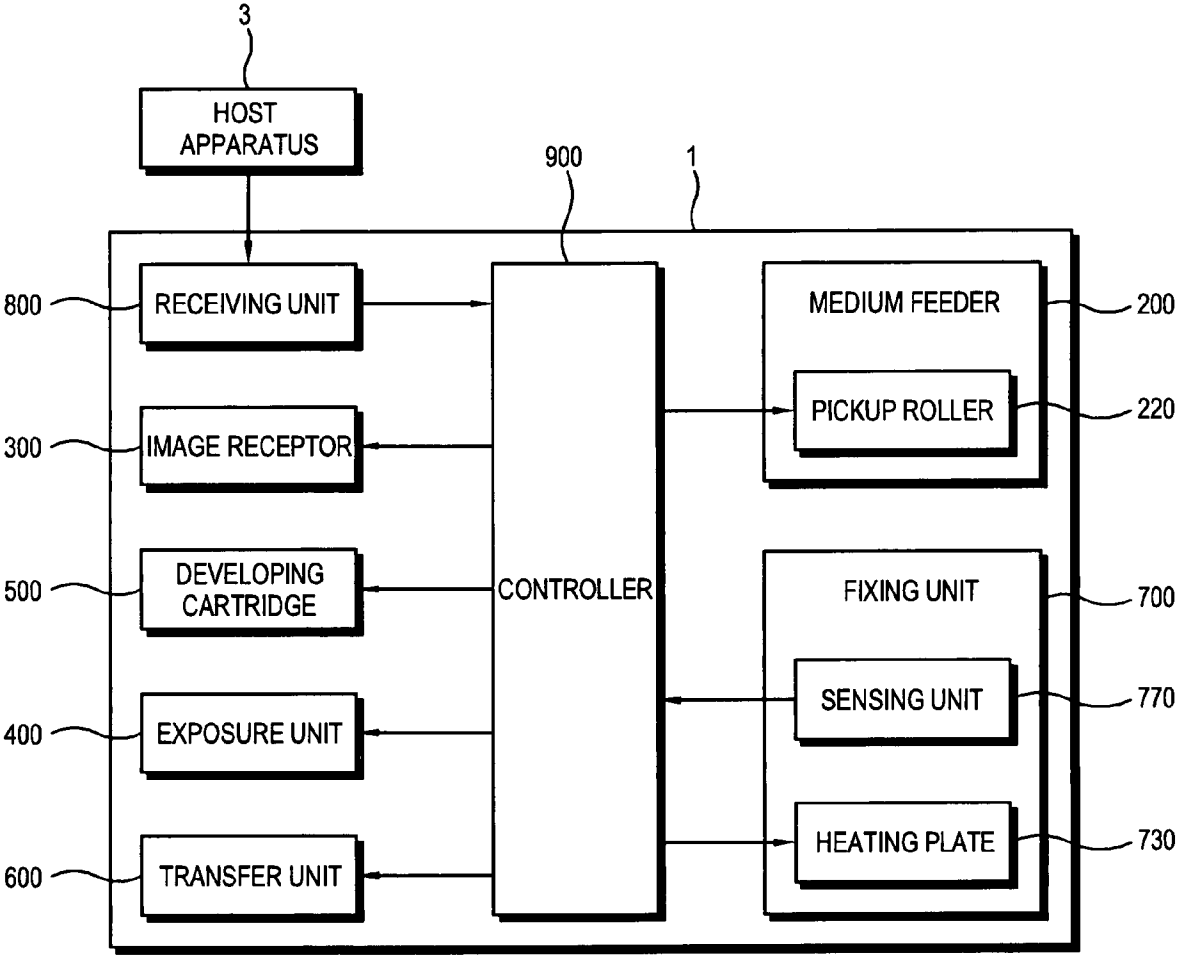
FIG. 3 is a control block diagram of the image forming apparatus shown in FIG. 1.

Hereinafter, the control structure of forming an image on a printing-target medium M in the image forming apparatus 1 will be described with reference to FIG. 3. FIG. 3 is a control block diagram of the image forming apparatus 1.

As shown in FIG. 3, the image forming apparatus 1 may further include a receiving unit 800 which receives image data from a host apparatus 3; and the controller 900 which controls the operations of various components of the image forming apparatus 1 to form an image based on the image data received by the receiving unit 800.

If the receiving unit 800 receives image data, the controller 900 may check a fixing reference temperature corresponding to a type of the present printing-target medium M and compute a pickup timing temperature by subtracting a predetermined temperature value from the checked fixing reference temperature. The fixing reference temperature may be differently determined according to the types of the printing-target media M, and the temperature value which is subtracted from the fixing reference temperature to compute the pickup timing temperature may also be set in various ways according to the image forming apparatus 1.

The controller 900 may control the heating plate 730 of the fixing unit 700 to heat the fixing unit 700 such that the temperature of the fixing unit 700 reaches the fixing reference temperature. The controller 900 may switch the power application to the heating plate 730 by using a duty control method to heat the heating plate 730 such that the temperature thereof reaches a predetermined temperature or maintain the temperature of the heating plate 730 to be a predetermined temperature.

The duty control method is a method of controlling the temperature of the heating plate 730 to be increased or decreased by supplying a power to the heating plate 730 or stopping the supplying of the power thereto. The duty control method may control a temperature of the heating plate 730 by adjusting a duty control rate. For example, the controller 900 may control the increase in temperature more smoothly by decreasing the switching rate of the power application to the heating plate 730 during a predetermined clock interval.

If the temperature of the fixing unit 700 reaches the pickup timing temperature while the fixing unit 700 is heated, the controller 900 may actuate the pickup roller 20 to pick up and feed the printing-target media M. Then, the controller 900 may control the image receptor 300, the exposure unit 400, the developing cartridge 500, and the transfer unit 600 to form an image on the printing-target medium M and the fixing unit 700 to fix the printed medium M.

Here, a period of time between a point of time when the printing-target medium M is picked up by the pickup roller 220 and a point of time when the printed medium M goes to the fixing unit 700 may be predetermined according to the image forming apparatus 1. Accordingly, the pickup timing temperature may be determined such that the temperature of the fixing unit 700 approaches to within a predetermined temperature range with regard to at least the fixing reference temperature at the point of time when the printed medium M goes to the fixing unit 700.

In the meantime, as the stand-by state of the image forming apparatus 1 is elongated, the initial temperature of the fixing unit 700 may be relatively lower. In this case, if the printing-target medium M is picked up at a point of time corresponding to a pickup timing temperature determined as described above, the temperature of the fixing unit 700 may be lower than that of the fixing reference temperature at a point of time when the back side of the printed medium M is fixed in the fixing unit 700. If such a phenomenon is generated, the fixing may abnormally be performed, i.e., a fixing error may be generated, at the back side of the printed medium M due to the insufficiency of heat for fixing in the fixing unit 700.

Figure 4:
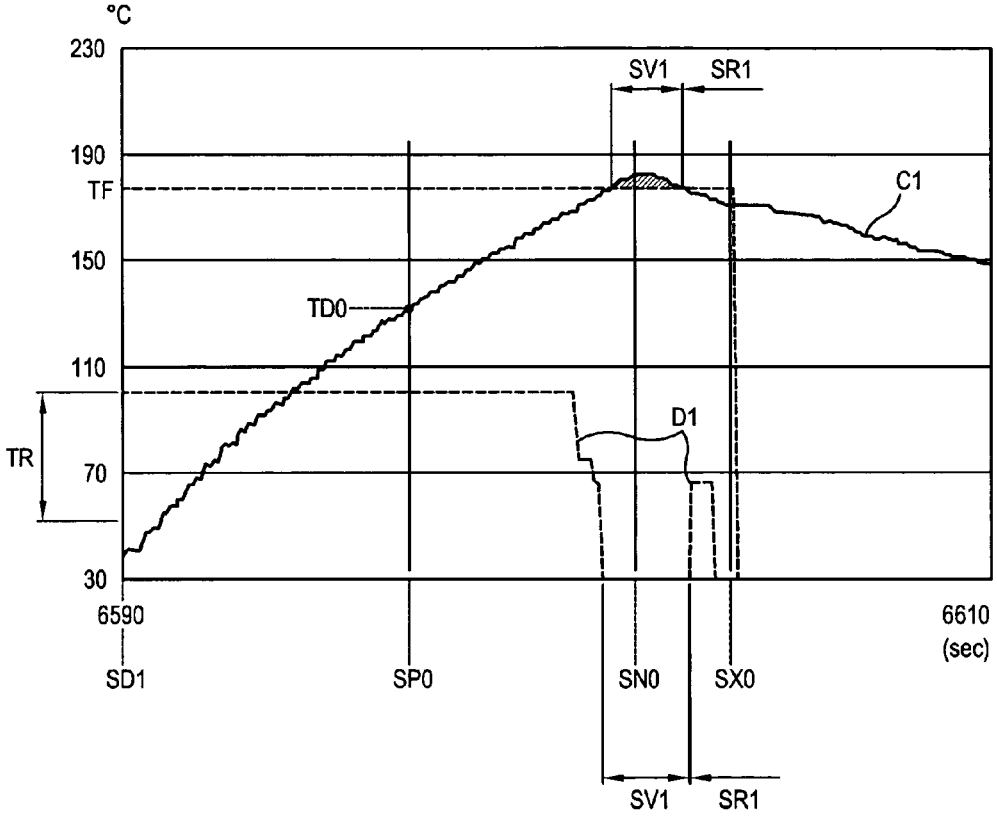
FIG. 4 is a graph showing how the temperature of a fixing unit is changed, the fixing unit being heated such that the temperature thereof reaches a fixing reference temperature in the case that the initial temperature of the fixing unit is relatively lower when a printing operation is started.

Hereinafter, an example showing how the printing-target medium M is picked up and the printed medium M is fixed in the case that the initial temperature of the fixing unit 700 is relatively lower as described above will be described with reference to FIG. 4. FIG. 4 is a graph showing how the temperature of a fixing unit is changed, the fixing unit being heated such that the temperature thereof reaches a fixing reference temperature TF in the case that the initial temperature of the fixing unit 700 is relatively lower when a printing operation is started.

It is to be noted that the following figures are merely examples and do not restrict the spirit and scope of the exemplary embodiments. Moreover, the following figures may vary depending on the environment of the image forming apparatus 1. In the following example, the temperature unit is centigrade.

In FIG. 4, the horizontal axis of the graph indicates time, and the vertical axis thereof indicates temperature. Alternatively, the vertical axis may indicate the duty control rate for controlling the temperature of the fixing unit 700.

If the printing operation is started, the controller 900 may check the predetermined fixing reference temperature TF corresponding to the printed medium M of the fixing unit 700 and a pickup timing temperature TD0 and, then, control the fixing unit 700 to be heated such that the temperature of the fixing unit 700 reaches the predetermined fixing reference temperature TF. A curve C1 shows how the temperature of the fixing unit 700 is changed.

If the temperature of the fixing unit 700 goes to an overshoot section SV1 where the temperature thereof is increased beyond the fixing reference temperature TF, the controller 900 may perform the duty control such that the fixing unit 700 is not heated. Accordingly, the temperature of fixing unit 700 may be kept in the overshoot section SV1 for a predetermined period of time and, then, goes to an undershoot section SR1 where the temperature thereof is lower than the fixing reference temperature TF (a characteristic of the fixing unit). A curve D1 shows how the temperature thereof is changed when the duty control is performed.

For example, if the printing-target medium M is a typical plain type and the corresponding fixing reference temperature TF is set to be 180 degrees, the controller 900 may set the pickup timing temperature TD0, i.e., 130 degrees, to be lower than the fixing reference temperature TF, i.e., 180 degrees, by a predetermined temperature value, e.g., 50 degree.

The controller 900 may control the printing-target medium M to be picked up at a point of time SP0 when the temperature of the fixing unit 700 that is being heated has reached the pickup timing temperature TD0. Then, the printed medium M may go to the fixing unit 700 at a point of time SN0 for going to fixing unit 700 in order to be subjected to the fixing. Then, the printed medium M may be separated from the fixing unit 700 and outputted to an outside of the image forming apparatus 1 at a point of time SX0 for being separated from the fixing unit 700.

Meanwhile, as the stand-by state of the image forming apparatus 1 is relatively elongated before the printing operation is started, the initial temperature of the fixing unit 700 may relatively be lower.

As the printing operation is started, the controller 900 may sense the initial temperature of the fixing unit 700 through the sensing unit 770. When the controller 900 senses the initial temperature thereof is referred to as "temperature sensing time SD1." The temperature sensed at the temperature sensing time SD1 may be lower than a predetermined reference temperature or a predetermined reference temperature range TR. In the present embodiment, the predetermined reference temperature range TR may be set to be in the range between about 50 and about 100 degree, for example. However, it can be varied.

In this case, the point of time SN0 for going to the fixing unit 700 may be in the overshoot section SV1. Accordingly, a front side of the printed medium M may be expected to be normally fixed. On the other hand, since the point of time SX0 for being separated from the fixing unit 700 is in the undershoot section SR1, the fixing error may be generated at the back side of the printed medium M due to the insufficiency of heat for the fixing.

In the present embodiment, if the initial temperature of the fixing unit 700 is lower than the predetermined reference temperature range TR as the printing operation is started, the pickup timing temperature TD0 may be compensated or adjusting and the printed medium M may be picked up at a point of time corresponding to the compensated pickup timing temperature TD0. Accordingly, it is possible to prevent such an above fixing error from being generated at the back side of the printed medium M.

Figure 5:
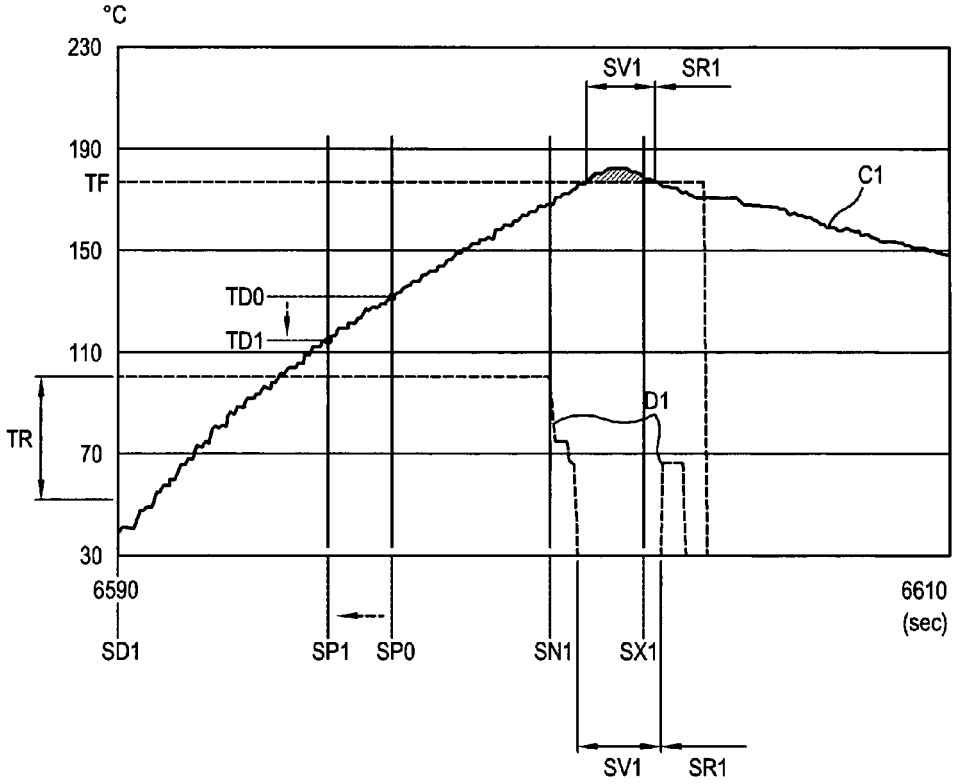
FIG. 5 is an example showing how a pickup timing temperature is compensated in the case of FIG. 4.

Hereinafter, an example of the configuration of compensating the pickup timing temperature TD0 in accordance with the embodiment will be described with reference to FIG. 5. FIG. 5 is an example showing how the pickup timing temperature TD0 is compensated in the graph shown in FIG. 4. In FIG. 5, a curve C1, a curve D1, a temperature sensing time SD1, a fixing reference temperature TF, and a reference temperature range TR are the same as those of FIG. 4.

In an embodiment, if the sensed initial temperature of the fixing unit 700 is lower than the reference temperature TF as the printing operation is started, the controller 900 may perform the compensation of a value of the pickup timing temperature TD0 as a relatively lower temperature. For example, when the difference between the default value of the pickup timing temperature TD0 and the fixing reference temperature TF is −50, the controller 900 may perform such offset compensation by determining the difference as, e.g., −60 to be greater than −50.

Such offset compensation may lower the pickup timing temperature from TD0 to TD1. The controller 900 may control the printed medium M to be picked up at a point of time SP1 for the pickup when the temperature of the fixing unit 700 that is being heated has reached the compensated pickup timing temperature TD1. As such, as the pickup timing temperature is lowered from TD0 to TD1, the point of time for the pickup may be advanced from SP0 to SP1 by a predetermined period of time. Moreover, as the point of time for the pickup is advanced from SP0 to SP1, the points of time SN1 and SX1 for going to and being separated from the fixing unit 700 may be made advanced as compared with the case of FIG. 4.

Especially, the point of time SX1 for being separated from the fixing unit 700, which is in the undershoot section SR1 in the case of FIG. 4, may be adjusted and thus in the overshoot section SV1. Accordingly, it is possible to improve the fixing performance at the back side of the printed medium M as compared with the case of FIG. 4 by determining the fixing temperature at the back side thereof to be equal to or higher than the fixing reference temperature TF.

In the meantime, the point of time SN1 for going to the fixing unit 700 may be adjusted and thus positioned beyond the overshoot section SV1. The adjusted point of time SN1 for going to the fixing unit 700 may be the process where the temperature of the fixing unit 700 is increased by allowing the fixing unit 700 to be heated under the control of the controller 900. In other words, since some of the fixing heat of the fixing unit 700 is absorbed into the printed medium M by the fixing of the printed medium M, the remaining fixing heat of the fixing unit 700 may be sufficiently maintained. Accordingly, it is possible to prevent the fixing error from being generated at the front side of the printed medium M.

Further, as the point of time for the pickup is advanced from SP0 to SP1, it is possible to save the time necessary for the initial printing operation of the printing-target medium M in the image forming apparatus 1.

Figure 6:
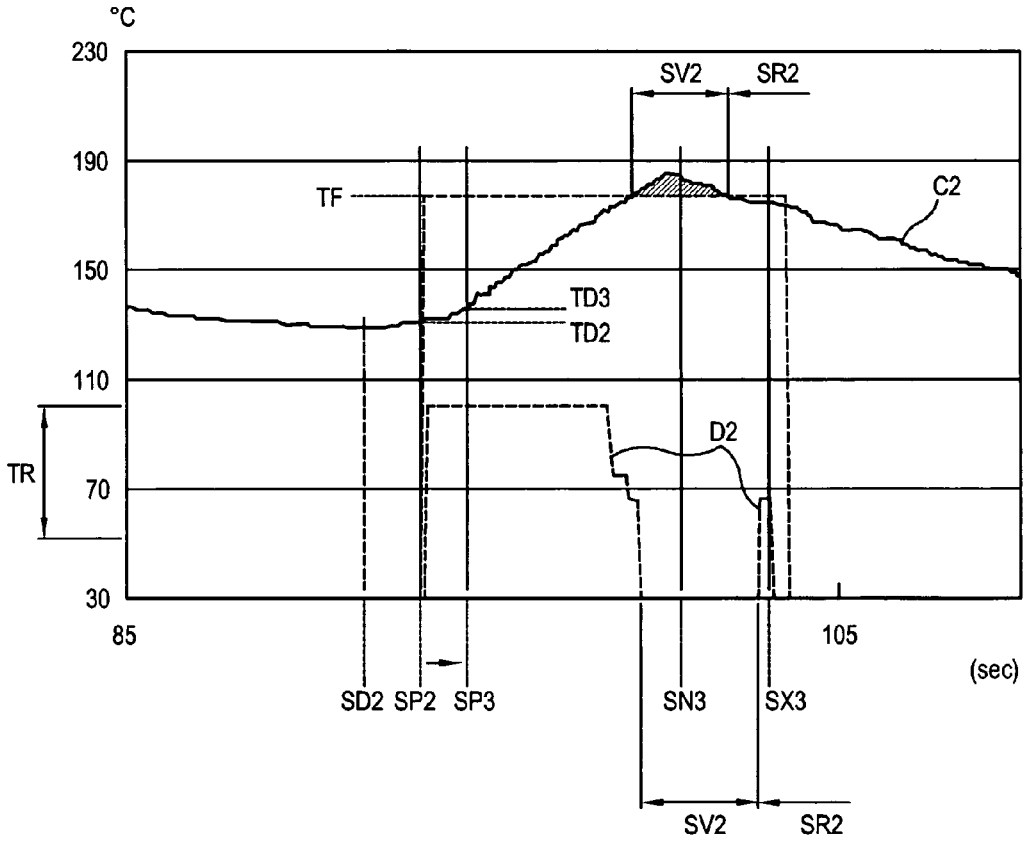
FIG. 6 is a graph showing how the temperature of a fixing unit is changed, the fixing unit being heated such that the temperature thereof reaches a fixing reference temperature in the case that the initial temperature of the fixing unit is relatively higher when a printing operation is started.

An example of compensating a pickup timing temperature TD2 in the case that the initial temperature of the fixing unit 700 is higher than the reference temperature range TR will be described with reference to FIG. 6. FIG. 6 is a graph showing an example of compensating the pickup timing temperature TD2 in the case that the initial temperature of the fixing unit is relatively higher than the reference temperature range TR.

In FIG. 6, a curve C2 shows how the temperature of the fixing unit 700 is changed, and a curve D2 shows the duty control of the controller 900 for heating the fixing unit 700.

If the printing operation is started, the controller 900 may check the fixing reference temperature TF and the pickup timing temperature TD2 and, then, control the fixing unit 700 such that the temperature thereof reaches the fixing reference temperature TF. The controller 900 may sense the temperature of the fixing unit 700 at a predetermined temperature sensing time SD2.

For example, if the sensed temperature is 130 degrees that is higher than the fixing reference temperature TF, the controller 900 may perform a compensation of a pickup timing temperature TD2 as a relatively higher temperature. For example, when the difference between the default of the pickup timing temperature TD2 and the fixing reference temperature TF is −50, the controller 900 may perform a compensation by determining the difference as, e.g., −40 to be smaller than −50.

Such compensation may increase the pickup timing temperature from TD2 to TD3. The controller 900 may control the printed medium M to be picked up at a point of time SP3 for the pickup corresponding to the pickup timing temperature TD3 instead of the point of time SP2 for the fixing corresponding to the pickup timing temperature TD2. In other words, as the pickup timing temperature is increased from TD2 to TD3, the point of time for the pickup may be delayed from SP2 to SP3 by a predetermined period of time. Moreover, as the point of time for the pickup is delayed from SP2 to SP3, points of time SN3 and SX3 for going to and being separated from the fixing unit 700 may also be adjusted and thus delayed.

The adjusted point of time SX3 for being separated from the fixing unit 700 may be positioned in the undershoot section SR2. However, in the case of FIG. 6 unlike FIG. 4, as the point of time for the pickup is delayed, the point of time SN3 for going to the fixing unit 700 may also be delayed. Accordingly, the overshoot section SV2 (a characteristic of the fixing unit) may be widened. More specifically, the time period between the point of time when the temperature of the fixing unit 700 is higher than the fixing reference temperature TF and the point of time for going to the fixing unit 700 may be elongated relatively as compared with before the adjustment.

Accordingly, since the heat for the fixing secured in the fixing unit 700 is relatively increased, even though some of the heat for the fixing is consumed while the printed medium M passes though the fixing unit 700, the fixing unit 700 may sufficiently secure the heat for the fixing at the back side of the printed medium M.

Accordingly, although the point of time SX3 for the printed medium M being separated from the fixing unit 700 is positioned in the undershoot section SR2, it is possible to prevent the same fixing error as that of FIG. 4 from being generated at the back side of the printed medium M in the case of FIG. 6.

As such, in accordance with the present embodiment, if the printing operation is started, the controller 900 may control the fixing unit 700 to be heated such that the temperature thereof reaches the fixing reference temperature TF and sense the initial temperature of the fixing unit 700. Then, the controller 900 may compensate the pickup timing temperature TD2 according to whether the initial temperature of the fixing unit 700 is higher or lower than the predetermined reference temperature range TR and control the printing-target medium M to be picked up at a point of time corresponding to the compensated pickup timing temperature TD3. Accordingly, it is possible to prevent the fixing error from being generated at the back side of the printed medium M.

If the initial temperature of the fixing unit 700 is within the predetermined reference temperature range TR, the controller 900 may perform no additional compensation. In this case, when the printing-target medium M is picked up at the point of time corresponding to the pickup timing temperature TD0, the point of time SX0 for being separated from the fixing unit 700 may be positioned in the overshoot section SV1. Accordingly, it is possible to secure the fixing performance at the back side of the printed medium M.

In the above embodiment, the description is related to the case that the initial temperature of the fixing unit 700 is higher or lower than the predetermined reference temperature range TR. However, the spirit and scope of the exemplary embodiment are applicable to the case that the initial temperature thereof is higher or lower than a predetermined reference temperature instead of the predetermined range.

Hereinafter, an experiment supporting the exemplary embodiments will be described.

In the experiment, the optical density (OD) of the printed medium M on which an image has been formed and the fixing has been performed was firstly measured by using an OD meter. Then, a tape was attached on the image of the measured medium M and, then, a weight of 500 g was moved back and forth 3 times. Thereafter, the tape was removed and, then, the OD thereof was secondly measured at the same positions. Finally, the fixing performance was computed by using the following equation 1.

$$F=(OD2/OD1)\times 100(\%), \quad \text{[Equation 1]}$$

where F indicates the fixing performance, OD1 indicates the firstly measured OD, and OD2 indicates the secondly measured OD.

The following tables 1 to 3 show the experiment data that were identically applied according to the initial temperatures of the fixing unit 700 without changing the pickup timing temperature when the initial temperatures of the fixing unit 700 were set to be 60, 25, and 140 degree, respectively. All other conditions were the same in the image forming patterns of the printing-target media M, the image forming apparatus performing the printing operations, and the standard of the printing-target media M.

TABLE 1

| Measured position | OD1 | OD2 | F(%) |
|---|---|---|---|
| Front left side | 1.14 | 1.11 | 97.7 |
| Front right side | 0.98 | 0.96 | 98.5 |
| Central side | 1.21 | 1.17 | 96.7 |
| Back left side | 1.10 | 1.03 | 94.5 |
| Back right side | 1.14 | 1.08 | 95.2 |

TABLE 2

| Measured position | OD1 | OD2 | F(%) |
|---|---|---|---|
| Front left side | 1.22 | 1.21 | 99.7 |
| Front right side | 1.22 | 1.19 | 97.5 |
| Central side | 1.21 | 1.19 | 98.0 |
| Back left side | 1.10 | 0.96 | 87.7 |
| Back right side | 1.24 | 0.99 | 79.8 |

TABLE 3

| Measured position | OD1 | OD2 | F(%) |
|---|---|---|---|
| Front left side | 1.42 | 1.36 | 96.3 |
| Front right side | 1.25 | 1.16 | 93.3 |
| Central side | 1.14 | 1.07 | 94.2 |
| Back left side | 1.21 | 1.10 | 91.0 |
| Back right side | 0.98 | 0.87 | 88.8 |

As shown in table 1, when the initial temperature of the fixing unit 700 was set to be 60 degree, the overall fixing performance of the printed medium M is satisfactory.

However, the fixing performances measured at the back side of the printed medium are 87.7% and 79.8% in the table 2 and 91.0% and 88.8% in the table 3. This says that the fixing errors were generated. In other words, when the initial temperature is 25 degree, i.e., relatively lower as shown in table 2 or 140 degree, i.e., relatively higher as shown in table 3, the fixing errors are generated at the back side of the printed medium M.

Especially, it is seen that the fixing error is significantly generated at the back side of the printed medium M when the initial temperature of the fixing unit 700 is relatively lower.

The following tables 4, 5, and 6 show the experiment data that compensated the pickup timing temperatures corresponding to the initial temperatures of the fixing unit 700 in the exemplary embodiment when the initial temperatures of the fixing unit 700 were set to be 60, 25, and 140 degree, respectively. All other conditions were the same in the image forming patterns of the printing-target media M, the image forming apparatus performing the printing operations, and the standard of the printing-target media M.

TABLE 4

| Measured position | OD1 | OD2 | F(%) |
|---|---|---|---|
| Front left side | 1.11 | 1.10 | 98.7 |
| Front right side | 1.20 | 1.16 | 96.5 |
| Central side | 1.14 | 1.09 | 96.0 |
| Back left side | 1.05 | 1.00 | 95.2 |
| Back right side | 1.20 | 1.16 | 96.4 |

TABLE 5

| Measured position | OD1 | OD2 | F(%) |
|---|---|---|---|
| Front left side | 1.24 | 1.24 | 100.0 |
| Front right side | 1.30 | 1.30 | 100.0 |
| Central side | 1.02 | 1.00 | 98.0 |
| Back left side | 1.21 | 1.17 | 96.6 |
| Back right side | 1.24 | 1.18 | 95.2 |

TABLE 6

| Measured position | OD1 | OD2 | F(%) |
|---|---|---|---|
| Front left side | 0.98 | 0.96 | 98.3 |
| Front right side | 1.12 | 1.08 | 96.2 |
| Central side | 1.31 | 1.24 | 95.0 |
| Back left side | 1.01 | 0.97 | 96.0 |
| Back right side | 1.21 | 1.17 | 97.0 |

The table 4 corresponding to the case that the initial temperature of the fixing unit 700 was 60 degree, where the pickup timing temperature was not compensated, is not significantly different from the table 1.

In the case of the table 5 corresponding to the case that the initial temperature thereof was set to be 25 degree, the fixing performance measured at the back side of the printed medium M was significantly increased from 87.7% and 79.8% to 96.6% and 95.2%, respectively. Moreover, in the case of the table 6 corresponding to the case that the initial temperature thereof was set to be 140 degree, the fixing performance measured at the back side of the printed medium M was significantly increased from 91.0% and 88.8% to 96.0% and 97.0%, respectively.

As such, it is seen that the fixing performance measured at the back side of the medium M is significantly improved by compensating the pickup timing temperature corresponding to whether the initial temperature of the fixing unit 700 and controlling the printing-target media M to be picked up and fed at the point of time corresponding to the compensated pickup timing temperature in accordance with the embodiment.

Figure 7:
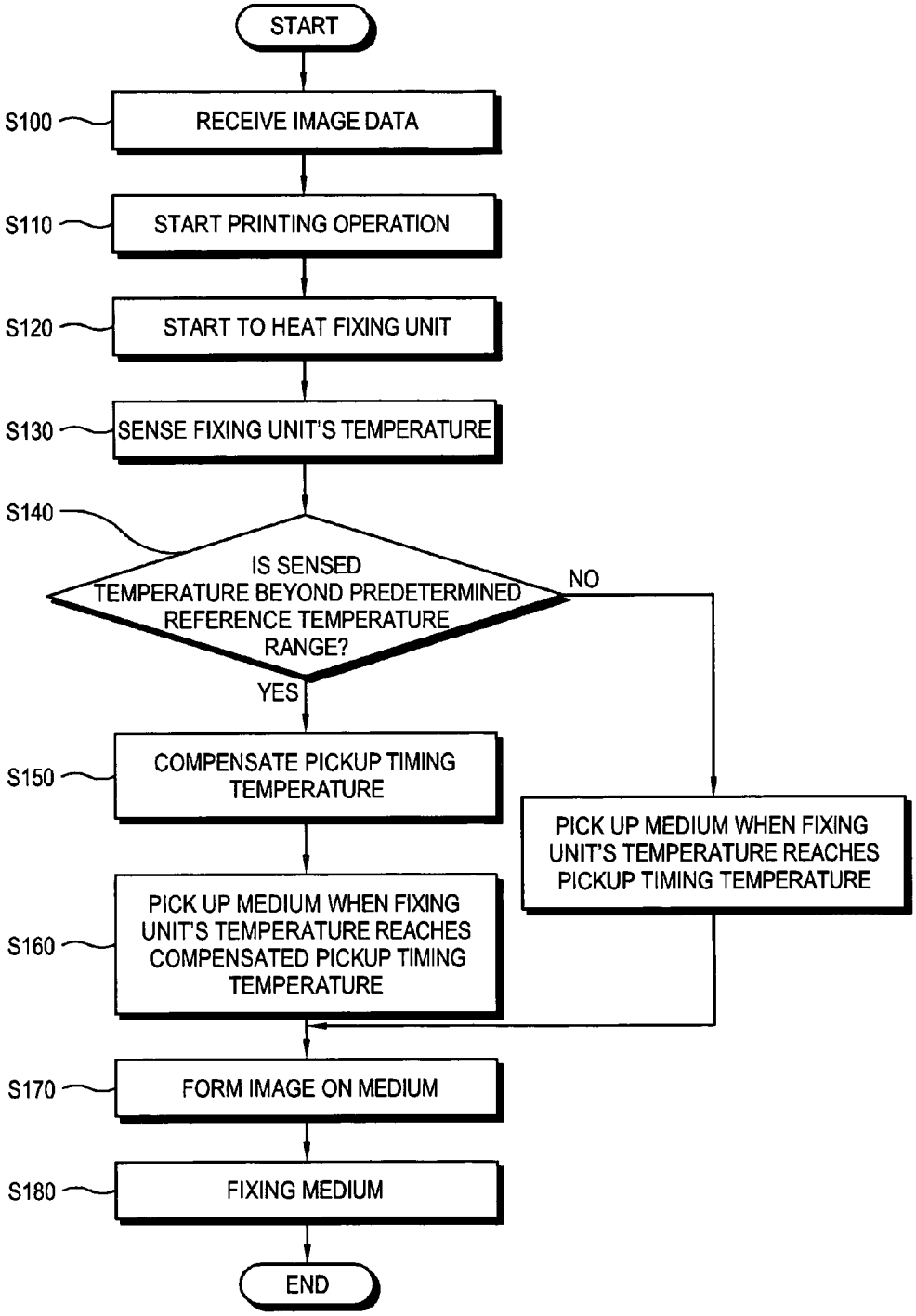
FIG. 7 is a control flowchart showing a control process of the image forming apparatus shown in FIG. 1.

Hereinafter, a method of controlling the image forming apparatus 1 in accordance with the embodiment will be described with reference to FIG. 7. FIG. 7 is a control flowchart showing such a control process.

As shown in FIG. 7, if the image forming apparatus 1 receives image data (S100), the controller 900 may start a printing operation (S110). As the printing operation is started, the controller 900 may start to control the fixing unit 700 to be heated such that the temperature thereof reaches the fixing reference temperature (S120) and sense the temperature of the fixing unit 700 (S130).

Then, the controller 900 may determine whether the sensed temperature thereof is beyond the predetermined reference temperature range (S140). If it is determined that the sensed temperature thereof is beyond the predetermined reference temperature range, the controller 900 may compensate the pickup timing temperature (S150). On the other hand, if it is determined that the sensed temperature thereof is within the predetermined reference temperature range, the controller 900 may pickup a medium without compensating the pickup timing temperature.

When the temperature of the heated fixing unit 700 has reached a compensated pickup timing temperature that has been subjected to the compensation or not subjected thereto in the previous stage, the controller 900 may control the printing-target medium M to be picked up (S160). An image may be formed on the picked-up printing-target medium M (S170) and, then, the printed medium M on which the image has been formed may be fixed (S180).

In this way, it is possible to prevent a fixing error from being generated at a back side of the printed medium M.

Figure 8:
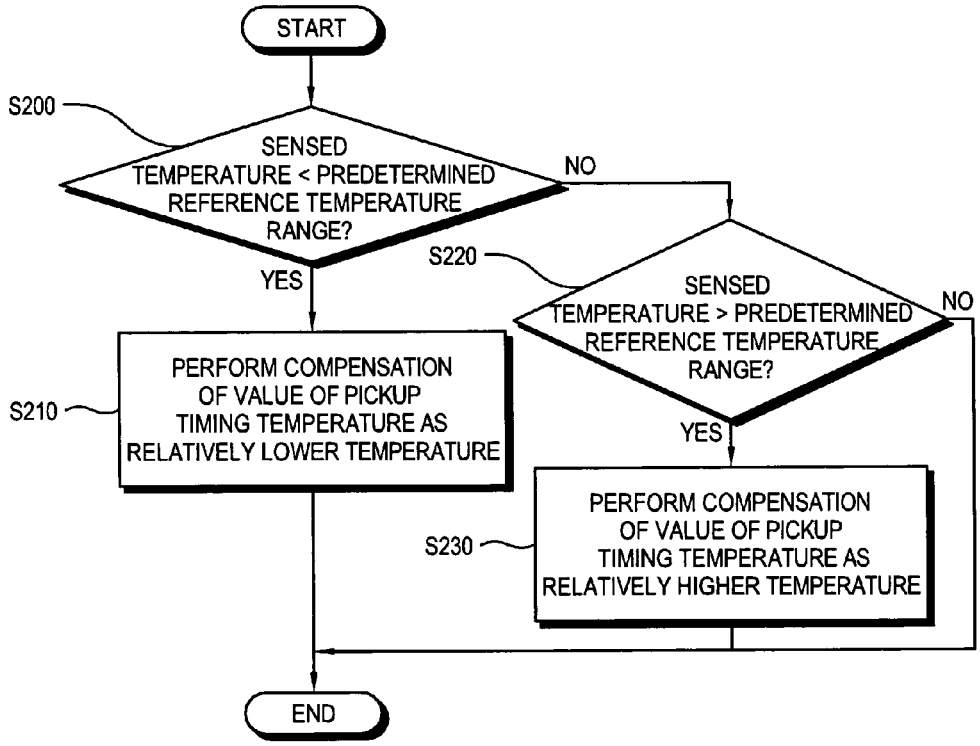
FIG. 8 is a control flowchart showing how a pickup timing temperature is compensated in the control process shown in FIG. 7.

Hereinafter, the aforementioned method of compensating the pickup timing temperature in the stage S150 will be described in more detail with reference to FIG. 8. FIG. 8 is a control flowchart showing such a process.

As shown in FIG. 8, if it is determined that the sensed temperature thereof is beyond the predetermined reference temperature range (S140 shown in FIG. 7), the controller 900 may determine whether the sensed temperature thereof is lower than the predetermined reference temperature range (S200).

If it is determined that the sensed temperature thereof is lower than the predetermined reference temperature range, the controller 900 may perform a compensation of value of the pickup timing temperature as a relatively lower temperature (S210).

On the other hand, if it is determined that the sensed temperature thereof is not lower than and higher than the predetermined reference temperature (S220), the controller 900 may perform the compensation of the value of the pickup timing temperature as a relatively higher temperature (S230).

In this way, it is possible to compensate the pickup timing temperature corresponding to the initial temperature of the fixing unit 700.

In the meantime, in an aspect of the embodiment, the value of the pickup timing temperature may be determined corresponding to the fixing reference temperature as described above. Here, the fixing reference temperature may be relatively lower depending on the types of the printing-target media M. For example, if it is assumed that the fixing reference temperature is 180 degree when the printing-target medium M is a typical plain type, an envelope, an OHP film, and a post card may have relatively lower fixing reference temperatures, e.g., 150, 145, and 150 degrees, respectively.

When an image is formed on such a printing-target medium having a relatively fixing reference temperature, an initial temperature of the fixing unit 700 may be lower than a predetermined reference temperature. In this case, if the pickup timing temperature is lowered as described above, a fixing error may be generated at a back side of the printed medium because an actually variable range of the pickup timing temperature is limited.

Accordingly, in this case, the pickup timing temperature may be compensated as shown in FIG. 5. Specifically, the fixing unit 700 may be heated during at least a partial time section of the overshoot section SV1 where the fixing unit 700 is not heated; eventually, the fixing reference temperature TF may be compensated as a relatively higher temperature. Accordingly, it is possible to prevent a fixing error from being generated at a back side of such a printed medium having a relatively lower fixing reference temperature.

Figure 9:
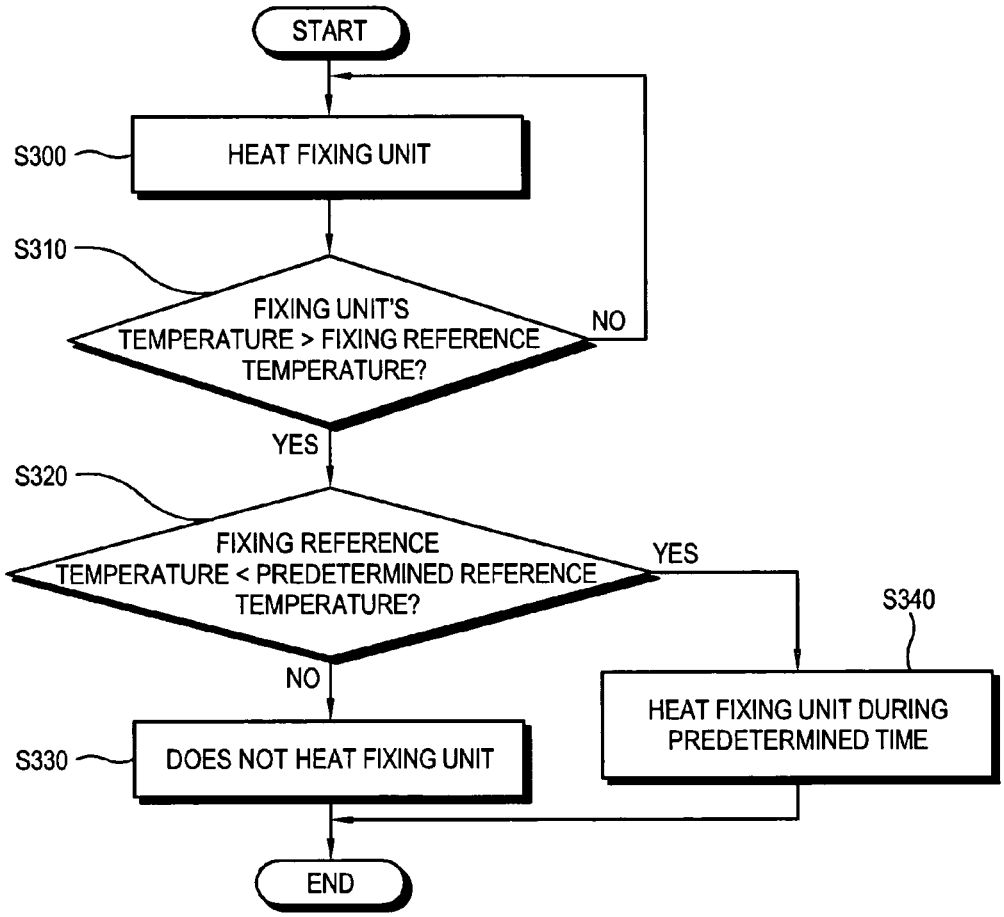
FIG. 9 is a control flowchart showing a process of controlling a fixing unit in accordance with another exemplary embodiment.

Hereinafter, a process of heating the fixing unit 700 in accordance with the present embodiment will be described with reference to FIG. 9. FIG. 9 is a control flowchart showing such a process.

As shown in FIG. 9, the controller 900 may control the fixing unit 700 to be heated as the printing operation is started (S300). The controller 900 may detect whether the temperature of the fixing unit 700 that is being heated is higher than the fixing reference temperature (S310). If it is detected that the temperature thereof is higher than the fixing reference temperature, the controller 900 may determine whether the fixing reference temperature is lower than a predetermined reference temperature (S320). Here, the predetermined reference temperature may be designed in various ways when the image forming apparatus 1 is embodied.

If it is determined that the fixing reference temperature is lower than the predetermined reference temperature, the controller 900 may control the fixing to be performed without heating the fixing unit 700 (S330). On the other hand, if it is determined that the fixing reference temperature is higher than the predetermined reference temperature, the controller 900 may control the fixing unit 700 to be heated in a predetermined time where the fixing reference temperature is higher than the predetermined reference temperature (S340).

In this way, it is possible to prevent a fixing error from being generated at the printed medium M where the fixing reference temperature is lower than the predetermined reference temperature.

In accordance with the embodiments, it is possible to easily minimize a fixing error generated at a back side of a printed medium by a simple configuration by compensating a pickup timing temperature according to the temperature of a fixing unit sensed corresponding to the start of a printing operation and picking up a printing-target medium at a point of time corresponding to the compensated pickup timing temperature.

In addition, by minimizing the fixing error of the printed medium by a simple configuration of software without adding a complex configuration of hardware, it is possible to remove a mechanical error such as tolerance, abrasion, or damage. Moreover, a manufacturing cost can be reduced.

Further, it is possible to secure image quality and fixing quality of the printed medium by flexibly dealing with the temperature of the fixing unit according to whether the temperature thereof is lower or higher when the printing operation is started.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A method of controlling an image forming apparatus comprising a medium feeder configured to load therein and to pick up and feed a printing-target medium; an image forming unit configured to form an image on the printing-target medium that is picked up and fed; and a fixing unit configured to fix the printed medium on which the image has been formed, the method comprising:

heating the fixing unit such that a temperature of the fixing unit reaches a fixing reference temperature corresponding to the printing-target medium if a printing operation is started;

sensing the temperature of the fixing unit corresponding to the start of the printing operation and compensating a pickup timing temperature corresponding to whether the sensed temperature thereof is higher or lower than a predetermined first reference temperature, and picking up the printing-target medium when the temperature of the fixing unit that is being heated reaches the compensated pickup timing temperature, wherein the compensating of a pickup timing temperature comprises performing compensation of a value of the pickup timing temperature as a relatively lower temperature if the sensed temperature of the fixing unit is lower than the predetermined first reference temperature.

2. The method of claim 1, wherein the picking-up of the printing-target medium comprises fixing the printed medium on which the image has been formed after being picked up, and the performing of compensation value of the pickup timing temperature as a relatively lower temperature comprises performing compensation of the pickup timing temperature such that the temperature of the fixing unit when the printed medium is separated from the fixing unit is equal to or higher than the fixing reference temperature.

3. The method of claim 1, wherein the picking-up of the printing-target medium comprises fixing the printed medium on which the image has been formed after being picked up, and the fixing of the printed medium comprises performing no heating of the fixing unit during at least a partial area of a time section where the temperature of the fixing unit higher than the fixing reference temperature such that the temperature of the fixing unit approaches to the fixing reference temperature while the printed medium is fixed; and heating the fixing unit during at least a part of the partial area if the sensed temperature of the fixing unit is lower than the first reference temperature and the fixing reference temperature is lower than a second reference temperature.

4. A method of controlling an image forming apparatus comprising a medium feeder configured to load therein and to pick up and feed a printing-target medium; an image forming unit configured to form an image on the printing-target medium that is picked up and fed; and a fixing unit configured to fix the printing medium on which the image has been formed, the method comprising:

heating the fixing unit such that a temperature of the fixing unit reaches a fixing reference temperature corresponding to the printing-target medium if a printing operation is started;

sensing the temperature of the fixing unit corresponding to the start of the printing operation and compensating a pick-up timing temperature corresponding to whether the sensed temperature thereof is higher or lower than a predetermined first reference temperature and picking up the printing-target medium when the temperature of the fixing unit that is being heated reaches the compensated pickup timing temperature, wherein the compensating of a pickup timing temperature comprises performing compensation a value of the pickup timing temperature as a relatively higher temperature if the sensed temperature of the fixing unit is higher than the first reference temperature.

5. The method of claim 4, wherein the performing compensation a value of the pickup timing temperature as a relatively higher temperature comprises performing offset compensation of the pickup timing temperature such that a time period between a point of time when the temperature of the fixing unit is higher than the fixing reference temperature and a point of time when the printed medium goes to the fixing unit is relatively elongated.

6. The method of claim 4, wherein a predetermined first temperature range comprises the first reference temperature, and the compensating of a pickup timing temperature comprises performing no compensation a value of the pickup timing temperature if the sensed temperature of the fixing unit is positioned in a first temperature range.

7. An image forming apparatus comprising:

a medium feeder configured to load therein and to pick up and feed a printing-target medium;

an image forming unit configured to form an image on the printing-target medium that is picked up and fed;

a fixing unit configured to fix by a heat the printed medium on which the image has been formed; and a controller configured to control the fixing unit such that a temperature of the fixing unit reaches a predetermined fixing reference temperature corresponding to the printing-target medium if an printing operation is started, to sense the temperature of the fixing unit corresponding to the start of the printing operation, to compensate a pickup timing temperature corresponding to whether the sensed temperature thereof is higher or lower than a predetermined first reference temperature, the pickup timing temperature being a temperature for picking up the printing-target medium, and to control the medium feeder to pick up the printing-target medium when the temperature of the fixing unit that is being heated reaches the compensated pickup timing temperature, wherein the controller performs offset compensation of a default value of the picking timing temperature as a relatively lower temperature if the sensed temperature of the fixing unit is lower than the first reference temperature.

8. The apparatus of claim 7, wherein the controller performs a compensation of the pickup timing temperature such that the temperature of the fixing unit when the printed medium is separated from the fixing unit is equal to or higher than the fixing reference temperature.

9. The apparatus of claim 7, wherein the controller performs no heating of the fixing unit during at least a partial area of a time section where the temperature of the fixing unit higher than the fixing reference temperature such that the temperature of the fixing unit approaches to the fixing reference temperature while the printed medium is fixed.

10. The apparatus of claim 9, wherein the controller controls the fixing unit to be heated during at least a part of the partial area if the sensed temperature of the fixing unit is lower than the first reference temperature and the fixing reference temperature is lower than a second reference temperature.

11. An image forming apparatus comprising:

a medium feeder configured to load therein and to pick up and feed a printing-target medium;

an image forming unit configured to form an image on the printing-target medium that is picked up and fed;

a fixing unit configured to fix by a heat the printed medium on which the image has been formed; and a controller configured to control the fixing unit such that a temperature of the fixing unit reaches a predetermined fixing reference temperature corresponding to the printing-target medium if an printing operation is started, to sense the temperature of the fixing unit corresponding to the start of the printing operation, to compensate a pickup timing temperature corresponding to whether the sensed temperature thereof is higher or lower than a predetermined first reference temperature, the pickup timing temperature being a temperature for picking up the printing-target medium, and to control the medium feeder to pick up the printing-target medium when the temperature of the fixing unit that is being heated reaches the compensated pickup timing temperature, wherein the controller performs a compensation of a value of the pickup timing temperature as a relatively higher temperature if the temperature of the fixing unit is higher than the first reference temperature.

12. The apparatus of claim 11, wherein the controller performs a compensation of the pickup timing temperature such that a time period between a point of time when the temperature of the fixing unit is higher than the fixing reference temperature and a point of time when the printed medium goes to the fixing unit is relatively elongated.

13. The apparatus of claim 11, wherein a predetermined first temperature range comprises the first reference temperature, and the controller performs no compensation of a value of the pickup timing temperature if the sensed temperature of the fixing unit is positioned in the first temperature range.

14. The apparatus of claim 11, wherein the fixing unit comprises a sensing unit to sense heat and a heating plate to heat the fixing unit.

15. A method of controlling an image forming apparatus comprising a medium feeder configured to load therein and to pick up and feed a printing medium; an image forming unit configured to form an image on the printing medium that is picked up and fed; and a fixing unit configured to fix the printing medium on which the image has been formed, the method comprising:

heating the fixing unit;

sensing the temperature of the fixing unit and compensating a pickup timing temperature based on the sensed temperature, and picking up the printing medium when the sensed temperature is the compensated pickup timing temperature, wherein the compensating comprises performing compensation of a value of the pickup timing temperature as a relatively lower temperature if the sensed temperature is lower than a predetermined reference temperature.

16. A method of controlling an image forming apparatus comprising a medium feeder configured to load therein and to pick up and feed a printing medium; an image forming unit configured to form an image on the printing medium that is picked up and fed; and a fixing unit configured to fix the printing medium on which the image has been formed, the method comprising:

heating the fixing unit;

sensing the temperature of the fixing unit and compensating a pickup timing temperature based on the sensed temperature, and picking up the printing medium when the sensed temperature is the compensated pickup timing temperature, wherein the compensating comprises performing compensation of a value of the pickup timing temperature as a relatively higher temperature if the sensed temperature is higher than a predetermined reference temperature.

* * * * *